US005090209A

United States Patent [19]

Martin

[11] Patent Number: 5,090,209

[45] Date of Patent: Feb. 25, 1992

[54] ENTHALPY CONTROL FOR CO2 REFRIGERATION SYSTEM

[75] Inventor: Patrick S. Martin, Dallas, Tex.

[73] Assignee: General Cryogenics Incorporated, Dallas, Tex.

[21] Appl. No.: 651,206

[22] Filed: Feb. 6, 1991

Related U.S. Application Data

[63] Continuation-in-part of Ser. No. 591,386, Oct. 1, 1990.

[51] Int. Cl.[5] ..... F25D 21/06

[52] U.S. Cl. ..... 62/50.3; 62/156; 62/275; 62/81; 62/526

[58] Field of Search ..... 62/140, 155, 156, 272, 62/275, 276, 526, 50.1, 50.2, 50.3, 50.4, 50.7, 51.1, 52.1, 217, 81, 80

[56] References Cited

U.S. PATENT DOCUMENTS

| | | | |
|---|---|---|---|
| 3,307,366 | 3/1967 | Smith | 62/5 |
| 3,335,576 | 8/1967 | Phillips | 62/156 |
| 3,802,212 | 4/1974 | Martin et al. | 62/52 |
| 3,861,167 | 1/1975 | Nijo | 62/209 |
| 4,045,972 | 9/1977 | Tyree, Jr. | 62/156 |
| 4,100,759 | 7/1978 | Tyree, Jr. | 62/55 |
| 4,186,562 | 2/1980 | Tyree, Jr. | 62/62 |
| 4,271,899 | 6/1981 | Noland | 62/156 X |
| 4,498,306 | 2/1985 | Tyree, Jr. | 62/119 |

OTHER PUBLICATIONS

Refrigerated Containerized Transport for "Jumbo" Jets, L. Tyree, Jr., 1971, pp. 521–525.

The Refrigerant Dilemma, Kira Gould, Fleet Owner, Sep. 1989, pp. 94–100.

Cryogenic Refrigeration: Wave of the Future?, Ken Stadden, Heavy Duty Trucking, Jul. 1990, p. 128.

*Primary Examiner*—Harry B. Tanner

*Attorney, Agent, or Firm*—Crutsinger & Booth

[57] ABSTRACT

A method and apparatus to refrigerate air in a compartment wherein liquid CO2 is delivered through a first primary heat exchanger such that sufficient heat is absorbed to evaporate the liquid carbon dioxide to form pressurized vapor. The pressurized vapor is heated in a gas fired heater to prevent solidification of the pressurized carbon dioxide when it is depressurized to provide isentropic expansion of the vapor through pneumatically driven fan motors into a secondary heat exchanger. Orifices in inlets to the fan motors and solenoid valves in flow lines to the fan motors keep the vapor pressurized while the heater supplies sufficient heat to prevent solidification when the CO2 vapor expands through the motors. CO2 vapor is routed from the second heat exchanger to chill surface in a dehumidifer to condense moisture from a stream of air before it flows to the heat exchangers.

22 Claims, 4 Drawing Sheets

ENTHALPY CONTROL FOR CO2 REFRIGERATION SYSTEM

CROSS REFERENCE TO RELATED APPLICATION

This application is a continuation-in-part of Application Ser. No. 07/591,386 filed Oct. 1, 1990 pending entitled "CARBON DIOXIDE REFRIGERATION SYSTEM".

TECHNICAL FIELD

The invention relates to a cryogenic refrigeration system including an enthalpy control system to prevent solidification of carbon dioxide to facilitate maintaining sub-zero temperature of air in a compartment.

BACKGROUND OF INVENTION

The temperature in the cargo compartment of refrigerated transport vehicles for frozen foods such as fish, meat and ice cream must be maintained below freezing.

U.S. Pat. No. 3,802,212 to Patrick S. Martin et al discloses a refrigeration system which utilizes liquefied cryogenic gas such as liquid nitrogen to control temperature in a cargo compartment in a transport vehicle. Difficulty has been encountered in systems using liquid carbon dioxide as the refrigerant because the temperature in the cargo compartment could not be maintained below approximately 30° Fahrenheit. The carbon dioxide solidified forming dry ice in the system, which required frequent defrosting. Thus, it did not have a commercially acceptable subfreezing capability.

Several patents disclose a back-pressure regulator in a liquid CO2 system between an evaporator and a gas driven motor employed in an effort to modify a liquid nitrogen system of the type disclosed in Martin et al U.S. Pat. No. 3,802,212 to prevent the formation of dry ice in the system by maintaining an operating pressure of 65 psig or higher.

Tyree U.S. Pat. No. 4,045,972 discloses improvements in Martin et al U.S. Pat. No. 3,802,212 including a temperature sensor and a back-pressure regulator installed in an effort to maintain a minimum pressure of, for example, 80 psia to prevent the formation of CO2 snow which could result in blockage or at least a reduced level of operation of the refrigeration system. Three embodiments of the liquid carbon dioxide refrigeration system are disclosed and the disclosure states that the embodiment illustrated in FIG. 4 can be particularly advantageous when it is desired to achieve a cargo compartment temperature of about −20° F. The disclosure states that liquid carbon dioxide is vaporized in a first heat exchanger, passes through a back-pressure regulator and then to a gas driven motor. The gas motor and an expansion orifice are described as being sized so that the temperature drop of the expanding vapor is limited so that carbon dioxide snow is not created.

Tyree U.S. Pat. No. 4,186,562 discloses a liquid carbon dioxide refrigeration system including a back-pressure regulator in the vapor line leading from a vaporizer to maintain a minimum pressure of, for example, 75 psia for the purpose of preventing the formation of snow. The major portion of the vapor stream is described as being expanded through one or more gas motors, passed through one or more additional heat exchangers, and then vented.

U.S. Pat. No. 4,100,759 to Tyree discloses a heat exchanger described as being of sufficient length so that all of the liquid carbon dioxide turns to vapor and exits through a back-pressure regulator that is set to maintain a pressure of at least 65 psig in the heat exchanger coil to prevent the formation of solid carbon dioxide. The carbon dioxide vapor flows 10 through a gas motor drivingly connected to a fan to circulate air in a cargo compartment past the heat exchanger.

The systems using carbon dioxide as a refrigerant have not enjoyed wide spread commercial acceptance because of the tendency of carbon dioxide to solidify and "freeze-up" the system. Recent studies indicate that the atmosphere is being so severely damaged by Freon and other chlorofluorocarbons (CFCs) that their use as refrigerants is being discouraged by governments worldwide. A dire need exists for a refrigeration system which uses a non-polluting refrigerant.

SUMMARY OF INVENTION

The carbon dioxide refrigeration system disclosed herein relates to improvements in refrigeration apparatus of the type disclosed in each of my prior U.S. Pat. No. 3,802,212, which issued Apr. 9, 1974, and my copending application Ser. No. 07/591,386 filed Oct. 1, 1990, entitled "CARBON DIOXIDE REFRIGERATION SYSTEM", the disclosures of which are incorporated herein by reference in their entireties for all purposes. Liquid carbon dioxide is directed through evaporator coils for cooling products in a cargo compartment and carbon dioxide vapor from the evaporator coils is directed through a pneumatically operated motor for driving a fan to circulate air in the compartment across surfaces of the evaporator coils. Carbon dioxide vapor, after passing through the evaporator coils and pneumatically driven motors, is exhausted through a secondary heat exchanger and a dehumidifier to atmosphere.

Improvements in the system include a heater to modify or control the enthalpy and entropy of the carbon dioxide by warming the carbon dioxide gas after it leaves the primary evaporator coils and before it reaches the pneumatically driven motors. A pair of solenoid actuated flow control valves and a pressure relief valve are mounted in the carbon dioxide line leading from the heater. The heater and pressure relief valve control the temperature and pressure of the carbon dioxide to assure that the carbon dioxide does not solidify when its pressure drops to near atmospheric pressure as it enters the chambers of the pneumatic motors.

CO2 is exhausted from the secondary heat exchanger of the evaporator to a dehumidifier to subject an air stream, partially saturated with water, to cooling below its dew point so that water vapor is condensed and separated from the air stream. To prevent freezing the condensate, a thermostatically controlled heater is provided in the line delivering CO2 to the dehumidifier to maintain the temperature of chilled surfaces in the dehumidifier slightly above the freezing point of water to facilitate drying the circulating air to minimize the formation of frost on the surfaces of the primary and secondary evaporator coils.

Carbon dioxide is a colorless, odorless gas of the composition CO2, which in the system hereinafter described is under an operating pressure of approximately 85 psig. If the pressure drops from 85 psig to 61 psig then the liquid carbon dioxide transforms to a solid state. On the other hand at the operating pressure of 85 psig, if temperature drops below −72° F. then the liquid carbon dioxide transforms to a solid state.

Temperature sensitive control apparatus regulates the flow rate of carbon dioxide vapor through the primary evaporator coils. If the temperature of carbon dioxide vapor exiting the primary evaporator and entering the fan motor is too low, the control apparatus diverts carbon dioxide through a vaporizer, mounted outside the vehicle and exposed to ambient temperature, and directs vapor from the vaporizer through a heating apparatus to defrost the system or to provide winter heating. The vapor is heated to a temperature of for example 1,000° F. and delivered through the evaporator coils and the pneumatic motors to melt frost from outer surfaces of the coils or to heat air circulated through the storage compartment for the heating mode.

A defrost mode is initiated when the temperature of carbon dioxide leaving the primary evaporator and delivered to the inlet of the pneumatic fan motor reaches a predetermined temperature of, for example, less than −70° F. indicating that frost has formed on the primary evaporator coils restricting heat transfer from an air stream to the CO2 inside the coils. When the temperature of the carbon dioxide reaches the predetermined temperature at which the carbon dioxide is at the point of passing through a phase change from vapor to liquid a defrost mode is initiated. If the carbon dioxide does not vaporize or if vapor is allowed to condense and become liquid, the liquid experiences a significant pressure drop as it passes through the pneumatic motor causing it to solidify forming dry ice which will restrict flow of carbon dioxide through the system.

The defrost mode is terminated by the control apparatus when the temperature of the surfaces of the evaporator coils have been heated to a predetermined temperature of, for example, above −60° F.

A primary object of the invention is to provide refrigeration apparatus particularly adapted to maintain subfreezing temperature in a compartment in a container or in any vehicle, such as a truck, transport trailer, railroad car, airplane or ship, which is self-contained and which utilizes liquefied carbon dioxide to refrigerate, heat and defrost a compartment without connection to an external power source.

Another object of the invention is to provide refrigeration apparatus utilizing liquefied carbon dioxide to provide a subfreezing refrigeration capacity without altering the normal oxygen content of air in the refrigerated cargo compartment.

Other and further objects of our invention will become apparent by reference to the detailed description hereinafter following and to the drawings annexed hereto.

DESCRIPTION OF THE DRAWINGS

Drawings of a preferred embodiment of the invention are annexed hereto so that the invention will be better and more fully understood, in which.

Numeral references are employed to designate like parts throughout the various figures of the drawing.

DESCRIPTION OF A PREFERRED EMBODIMENT

Figure 1:
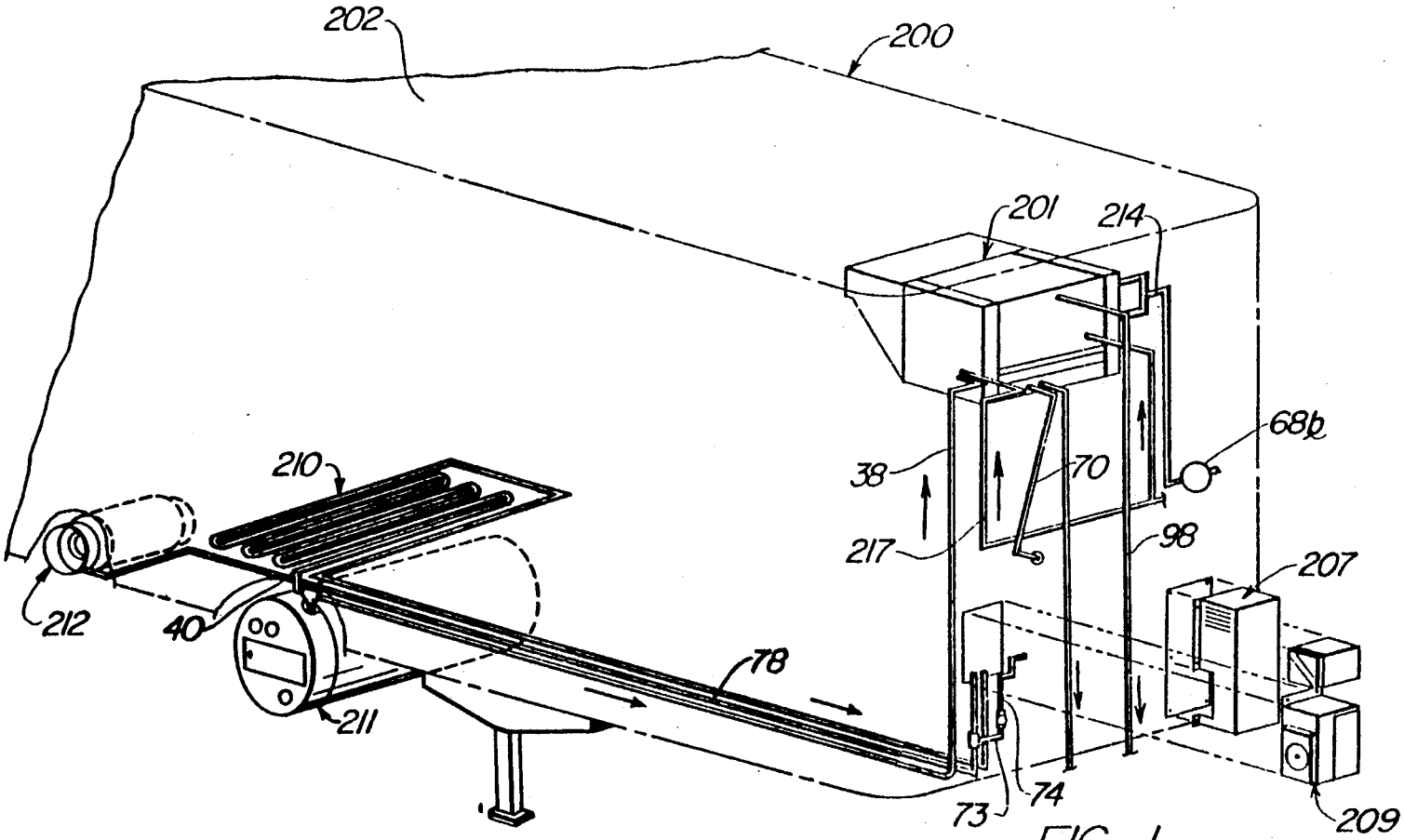
FIG. 1 is a diagrammatic perspective view of a transport vehicle illustrating a typical distribution of the components of the liquid carbon dioxide refrigeration apparatus installed thereon.
Figure 2:
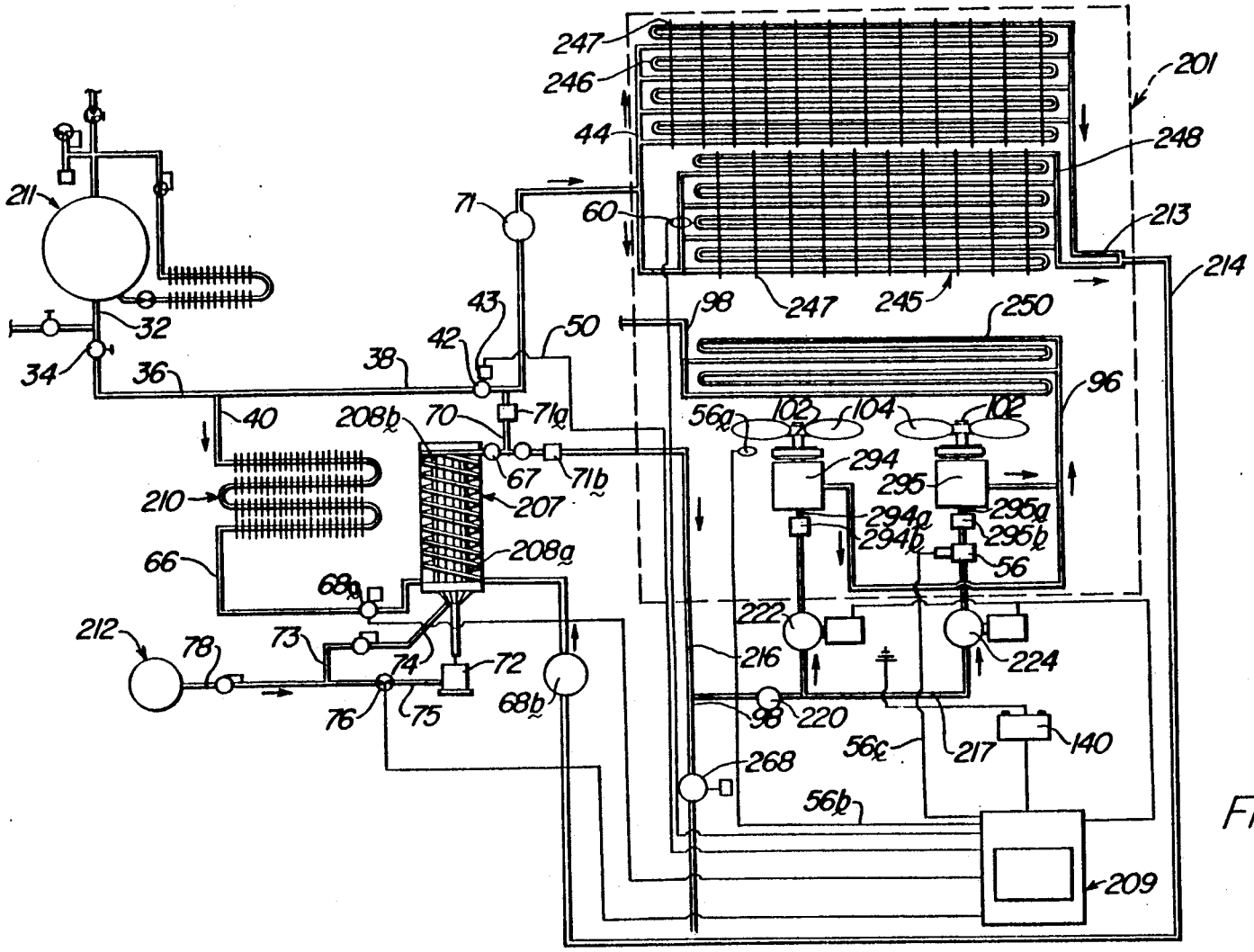
FIG. 2 is a schematic diagram of the liquid carbon dioxide refrigeration apparatus.

Referring to FIGS. 1 and 2 of the drawing the numeral 200 generally designates a vehicle having the carbon dioxide refrigeration system mounted therein for cooling an interior cargo compartment to subfreezing temperatures. The refrigeration system includes an evaporator 201 connected to a source 211 of liquid carbon dioxide and a controller 209 powered by a battery 140.

Latent heat of vaporization is absorbed by liquid carbon dioxide in the evaporator 201 and latent heat of condensation of water is extracted from a stream 400 of humid air in a dehumidifier 300 during the changes of state of the carbon dioxide in the evaporator 201 from liquid to vapor and the change in state of moisture in the humid air in dehumidifier 300 form vapor to liquid. Heaters 207 and 307 in the system control the temperature of CO2 flowing through the system to control the enthalpy of the CO2 to prevent solidification of CO2 in the system and to extract moisture from the air stream to prevent icing and consequently insulation of heat transfer surfaces. Controlling phase changes of the CO2 in heat exchangers 246 and 248 and moisture in the air stream 400 flowing across the heat exchangers 246 and 248 results in efficient heat transfer between the air and the non-polluting CO2 refrigerant.

In the particular embodiment of the invention illustrated in FIG. 1, the evaporator 201 is secured to an upper portion of front end wall of the transport 200 and is arranged to force cooled air through a plurality of air ducts (not shown) of varying lengths such that cooled air is distributed uniformly throughout the cargo compartment 202.

The refrigeration system incorporates apparatus for heating the cargo compartment which includes a source of any suitable fuel, such as tank 212 of liquefied or compressed natural gas, propane, or ethanol connected to a heating unit 207. Liquid carbon dioxide is delivered through a vaporizer 210 to the heating unit 207 which delivers heated carbon dioxide through the coils of evaporator 201 for defrosting coils of the evaporator or for circulating warm air through the cargo compartment if heating is required.

Figure 4:
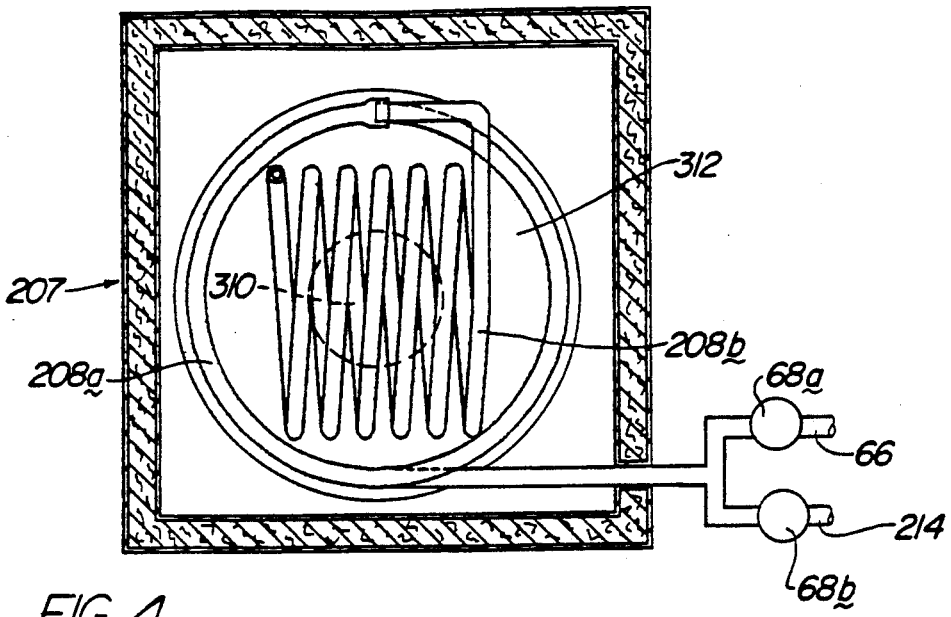
FIG. 4 is a cross sectional view taken along line 4—4 of FIG. 3.
Figure 3:
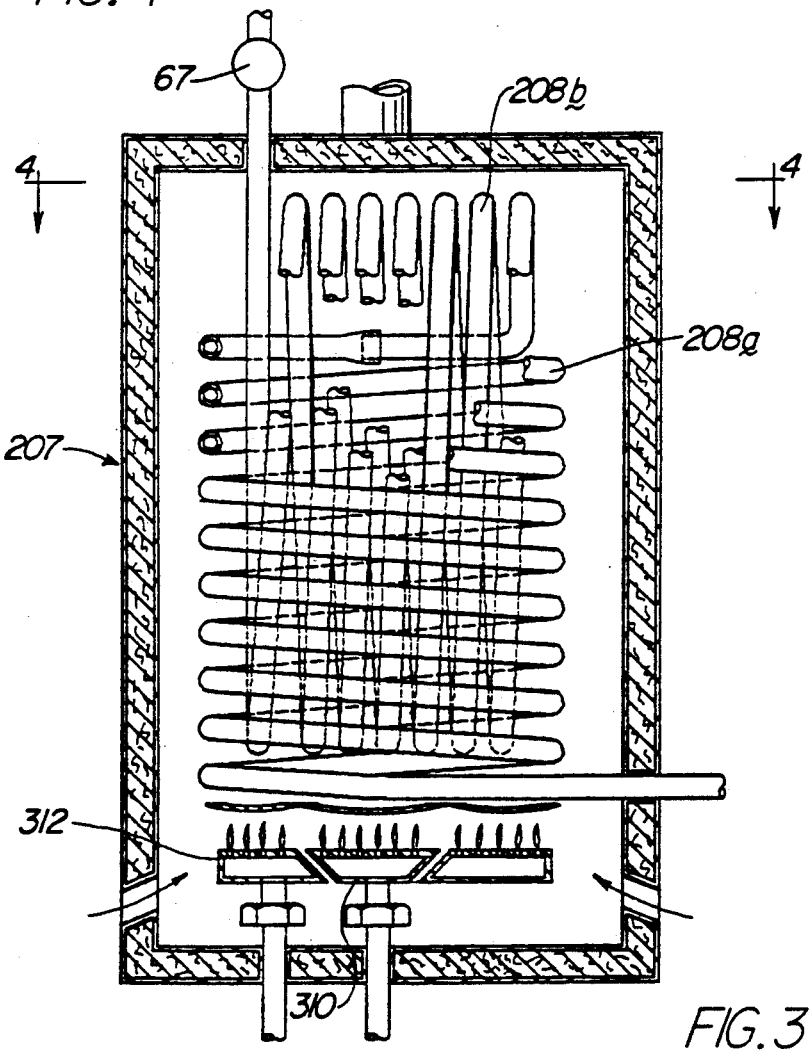
FIG. 3 is a cross sectional view through the heating unit.

The heating unit 207, best illustrated in FIGS. 3 and 4 of the drawing, preferably has coils **208*a* and 208*b* arranged such that axes of the coils are generally perpendicular and preferably has dual burners 310 and 312. The relatively small burner 310 provides low heat for heating vapor exhausted from the primary cooling coils 246 and 248 of the primary heat exchangers for controlling the enthalpy to prevent solidification of carbon dioxide vapor in motors 294 and 295. The second larger burner 312 has significantly greater heating capacity than the smaller burner 310** to provide heat necessary for the defrost mode and cargo heating mode.

The outer coil **208*a* has an inlet connected through valve 68*a* to pipe 66 communicating with vaporizer 210 and through a valve 68*b* to conduit 214 through which carbon dioxide vapor is exhausted from the pair of primary cooling coils 246 and 248. Solenoid actuated valves 68***a* and 68*b* are connected such that when valve 68*a* is open, valve 68*b* is closed and when valve 68*b* is open, valve 68*a* is closed. Thus, when the system is set for a cooling mode, valve 68*a* is closed. When the system is set for a cooling mode, valve 68*b* will be open and if sensors indicate that the temperature of CO2 flowing to motors 294 and 295 is too low and requires heating to prevent solidification of CO2 as a result of the pressure drop as it flows through the motors, the small burner 310 of heater 207 will be ignited. If sufficient heat is absorbed by the CO2 in the primary coil 246, valve 68*b*is open and the small burner 310 is not ignited so that CO2 vapor passing the heater is not heated.

Coils 208*a* and 208*b* of heater 207 are preferably heliarc welded stainless steel tubes capable of withstanding wide temperature changes. During the cooling mode, carbon dioxide vapor exhausted from the primary cooling coils 246 and 248 may have a temperature of, for example, below −45° F. and will be heated in the heater 207 to a temperature of, for example, above −30° F.

When the system is in a defrost mode, liquid carbon dioxide flowing through line 40 to vaporizer 210 may have a temperature of, for example, −60° F. which is to be heated to a temperature of, for example, 1,000° F. when a defrost cycle is initiated.

The exhaust side of the inner heating coil 208*b* is connected through valve 71*a* to the primary heating coils 246 and 248 and is connected through valve 71*b* to a line communicating with the solenoid actuated valves 222 and 224. When solenoid actuated valve 71*a* is open, solenoid actuated valve 71*b* is closed. When solenoid actuated valve 71*b* is open, solenoid actuated valve 71*a* is closed.

The heating coils 208*a* and 208*b* of heating unit 207 are preferably mounted in an insulated cabinet to provide control of heat supplied to the system. However, it should be appreciated that the heater must have both combustion and ventilation air. A pressure relief valve 67 is preferably mounted for relieving excessive pressure in the event of blockage of flow through the system for any reason.

An auxiliary bypass valve 268, illustrated in FIG. 2, is provided in a line which extends between conduit 214 and the inlets to solenoid actuated valves 222 and 224. When valve 268 is open, vapor from the primary cooling coils 246 and 248 is delivered through conduit 214 directly to the inlet of valves 222 and 224. In this mode of operation vapor is not circulated through heating unit 207. However, if temperature sensor 56 indicates that the temperature of carbon dioxide vapor flowing to pneumatic motor 295 is less than a predetermined value, for example, −45° F., valve 268 will be closed and valve 68*b* will open thereby routing the vapor from conduit 214 through heating unit 207 for supplying sufficient heat to raise the temperature of carbon dioxide vapor supplied through valve 71*b* to motors 294 and 295 to a temperature above the predetermined limit of, for example, −45° F. This assures that the enthalpy of carbon dioxide vapor delivered to the motors is in a range to prevent solidification of the carbon dioxide vapor flowing through orifices 294*b* and 295*b* and pneumatically driven motors 294 and 295.

Gas piping to the dual burners 312 and 310 of heating unit 207 is constructed to ignite the small burner 310 when temperature sensor 56 indicates that the temperature of carbon dioxide delivered to the pneumatic motors 294 and 295 is too low. Both the large burner 312 and the small burner 310 are supplied with fuel and are ignited during the defrost mode and heating mode.

While a single heating unit 207 connected as illustrated in FIG. 2 of the drawing is utilized for controlling the enthalpy of the carbon dioxide vapor used for cooling and also for heating carbon dioxide vapor during the defrost cycle, it should be readily apparent that separate heating units may be employed if it is deemed expedient to do so. For example, I contemplate using an inline electrical heating unit 307 as illustrated in the modified form of the invention illustrated in FIG. 5 of the drawing in heat exchange relation with conduit 214. In this form of the invention a section of conduit 214 is formed of copper, bronze or stainless steel and stainless steel heating elements 308 are wound around the conductive tube 214 for supplying heat to carbon dioxide vapor flowing through the tube. Heat supplied to carbon dioxide vapor, having pressure greater than atmospheric pressure, is controlled by a temperature sensor 356 mounted to control a relay 309 in a circuit containing battery 340 and heating elements 308. When the temperature in the outlet 214*b* of heater 307 is less than a predetermined temperature of, for example, −45° F., a signal is delivered to actuate relay 309. When the switch of relay 309 is closed, CO2 vapor flowing through conduit 214 is heated by heating elements 308.

Figure 5:
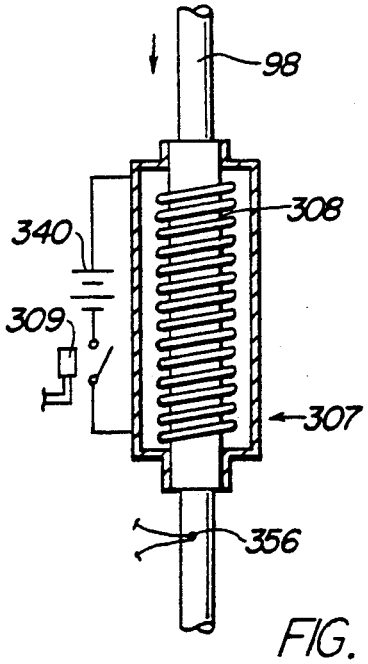
FIG. 5 is a diagrammatic view of a modified form of the enthalpy control system illustrating an electric heater.

The heater 207, in the embodiment of FIG. 2 or heater 307 in the embodiment of FIG. 5, is connected to the evaporator 201 for controlling the enthalpy of carbon dioxide vapor exhausted from the evaporator 201 and delivered to pneumatically driven motors. When the high pressured carbon dioxide vapor is exhausted through the motors 294 and 295 and the secondary cooling coil 250, it is depressurized in the chambers of the pneumatic motors and provides about four to eight BTUs of additional cooling capacity per pound of carbon dioxide. This is a form of isentropic expansion. However, when the vapor depressurizes, it becomes Very cold and if the pressure drop is excessive the carbon dioxide will solidify.

The enthalpy or heat content of a substance is a thermodynamic property defined as the internal energy plus the product of the pressure times the volume of the substance. If a substance undergoes a transformation from one physical state to another, such as a polymorphic transition, the fusion or sublimation of a solid, or the vaporization of a liquid, the heat absorbed by the substance during the transformation is defined as the latent heat of transformation. The heat absorbed by liquid carbon dioxide during the transformation from a liquid state to a vapor or gaseous state is generally referred to as the latent heat of vaporization.

Carbon dioxide, is non-toxic, has the lowest coefficient of performance of any of the general refrigerants, and has been used for the refrigerant in airconditioning installations and for food preservation on shipboard, but its high operating pressure and low critical temperature have been very objectionable.

The entropy, the relative disorder of the motion of the molecules, of a substance is a state property which has no outward physical manifestation such as temperature or pressure. Any process during which there is no change of entropy is said to be "isentropic".

Liquid carbon dioxide is delivered through a feed line 36 and distribution manifold 44 to an evaporator 201. In the embodiment of the evaporator 201 illustrated in FIG. 2 of the drawing, a pair of primary cooling coils 246 and 248 form a first heat exchanger which functions as a multiple coil primary evaporator 245. The primary cooling coils 246 and 248 preferably have heat conductive surface fins 247 to provide a substantial surface area for transfer of heat between air circulating over outer surfaces of the coils and carbon dioxide flowing through the coils. Liquid carbon dioxide vaporizes in the primary cooling coils 246 and 248 of the primary evaporator 225 as heat is absorbed from an air stream circulating over the coils and pressurized carbon dioxide vapor is exhausted to a heater 207 where the carbon dioxide vapor is warmed further to a temperature which will preclude solidification of the carbon dioxide in the system as will be hereinafter more fully explained.

The warmed carbon dioxide vapor, the maximum pressure of which is controlled by a pressure relief valve 220, is delivered through flow control orifices **294*b* and 295*b* to the inlets of at least one fluid driven motors 294 and 295. The outlet of each fluid driven motor 294 and 295 is connected to a secondary cooling coil 250 of a second heat exchanger which exhausts to atmosphere outside cargo compartment 202 after flowing through dehumidifier 300**.

Improvement in the system include heater 207 to modify or control the enthalpy and entropy of the carbon dioxide by warming the carbon dioxide gas after it leaves the finned primary cooling coils 246 and 248 of evaporator 225 and before it reaches the pneumatic motors 294 and 295, through pressure controlled carbon dioxide lines 216 and 217. The heater 207, solenoid actuated flow control valves 222 and 224 and pressure relief valve 220 control the temperature and pressure of the carbon dioxide to assure that the carbon dioxide does not solidify when its pressure drops to near atmospheric pressure as it is delivered through the pneumatic motors 294 and 295 and through the secondary coil 250, to atmosphere. The pressure relief valve 220 and solenoid actuated flow control valves 222 and 224 keep the system pressurized to a pressure of at least 65 psig to prevent the carbon dioxide from going to a solid when the system cycles off when temperature of air in the cargo compartment 220 is in a predetermined temperature range. As will be hereinafter more fully explained, sensor 56 initiates a defrost mode when the temperature of carbon dioxide delivered to motor 295 is too low and sensor 60 terminates the defrost mode when the surface of primary coils 246 and 248 increase to a predetermined temperature.

The source 211 of cryogenic gas is of conventional design and preferably comprises an insulated container having an outer shell and an inner shell spaced by a vacuum chamber. Liquid carbon dioxide and a volume of carbon dioxide vapor above the liquid carbon dioxide fill the container. A conventional pressure building system, which includes a pressure building valve connected through a vaporizer and pressure regulator valve to an upper portion of the tank, permits a small quantity of the liquid carbon dioxide to boil off to maintain a constant supply pressure of approximately 80 to 85 PSI (pounds per square inch) and a temperature about −60 degrees F.

Liquid carbon dioxide is delivered through an insulated tube 32, flow control valve 34 and line 36 to branch lines 38 and 40.

To provide a defrost and heating capability, the source of cryogenic gas 211 is connected through a vaporizer 210, preferably disposed outside the refrigerated cargo area 202, to a heating device 207. Heated vapor from heating device 207 is delivered through conduit 70 and a flow control orifice 71 to coils of evaporator 201 for defrosting the system and for causing heating air to be delivered through the cargo compartment if heating is required.

A controller 209, preferably mounted on the front of the transport 200 controls cooling, heating, defrosting and idle phases to maintain a set temperature range. It controls the flow of both hot and cold vapor through coils 246 and 248 of evaporator 201 and an indicator (not shown) is connected to suitable temperature sensing means inside cargo compartment 202 for providing a visual indication of the temperature therein.

Branch line 38 is connected through a solenoid actuated liquid feed valve 42 and inlet manifold 44 to primary coils 246 and 248 of evaporator 201.

The flow passage through liquid feed valve 42 is controlled by suitable actuating means 43 connected to a valve element in the body of the valve. Actuator 43 is preferably a solenoid having a movable element disposed therein such that a signal delivered through line 50 causes the movable element to move thereby shifting a valve element for controlling flow through liquid feed valve 42. Line 50 is connected to temperature controller 209.

Temperature controller 209 is of conventional design and preferably comprises a temperature sensor **56*a* connected through line 56*b* to control apparatus of the controller 209 to indicate the temperature of air circulating through the cargo compartment 202 and across evaporator 201. A signal from controller 209 through line 50 holds liquid feed valve 42 open so long as sensor 56*a* is maintained at a temperature higher than that set on a programmable thermostat in the controller, when the control is set for cooling. Controller 209 preferably has a visual indicator associated therewith to indicate the temperature of air in the cargo compartment 202** and has temperature recording apparatus associated therewith (not shown) for plotting temperature in relation to time. Such instruments are commercially available from the Partlow Corporation of New Hartford, N.Y.

During a cooling cycle liquid carbon dioxide passes through branch line 38, liquid feed valve 42, and inlet manifold 44 to the primary coils 246 and 248 of evaporator 201. Since liquid carbon dioxide is rather difficult to vaporize (to change from liquid to gas) within the evaporator coils 246 and 248 the coil surface area has been increased by anodized aluminum fins 247 to increase the efficiency of heat transfer between air circulating across the coils and carbon dioxide flowing through the coils.

For defrosting coils 246 and 248 of primary evaporator 225, motors 294 and 295, and secondary coil 250 of evaporator 201, controller 209 closes feed valve 42 and opens valve **68*a* so that liquid carbon dioxide is routed through branch line 40 to vaporizer 210. The vaporizer 210 is exposed to ambient atmosphere outside of the cargo compartment 202 to provide sufficient heating to vaporize the liquid carbon dioxide. Vapor from vaporizer 210 passes through line 66 and solenoid actuated valve 68*a* to the heating device generally designated by numeral 207. Heated vapor passing from heating device 207 passes through line 70 and flow control orifice 71 to evaporator 201**.

The heating device 207 comprises a burner 72 and a pilot light 74 connected through lines 73 and 75, respectively, to a gas supply valve 76. A suitable fuel, such as propane, is delivered through line 78 from tank 212.

Below 62 P.S.I.G. (pounds per square inch gauge), liquid carbon dioxide changes to a solid state (dry ice). To avoid this, the pressure builder maintains the pressure of tank 211 of carbon dioxide at a pressure higher than 70 PSIG and a pressure relief valve 220 is mounted between the primary evaporator coils 246 and 248 and the air motors 294 and 295. The pressure regulator 220 maintains pressure above 65 PSIG within the primary coils 246 and 248 of evaporator 201.

The pressure relief valve 220 communicates with conduit 216 through which carbon dioxide vapor flows from the heater 207, mounted outside cargo compartment 202, and a conduit 217 through which CO2 vapor is delivered to motors 294 and 295. Fluid from conduit 216 is delivered through pressure regulator 220 to the inlet opening of solenoid actuated flow control valve 222. The outlet of the solenoid actuated flow control valve 222 is connected to the inlet 294*a* of pneumatically driven motor 294. Similarly, the inlet opening of solenoid actuated flow control valve 224 is connected to the conduit 216 through pressure regulator 220 and the outlet of the solenoid actuated flow control valve 224 is connected to the inlet 295*a*of pneumatically driven motor 295. Flow limiting orifices 294*b* and 295*b* are mounted in the inlet 294*a* and 295*a* to each of the motors 294 and 295 to compensate for the high operating pressure of about 65 PSIG of the carbon dioxide vapor. These orifices balance the flow rate of liquid carbon dioxide to each of the primary cooling coils 246 and 248 and the flow of vapor from heater 207 to the motors 294 and 295.

A sensor 56 is positioned to generate a signal proportional to the temperature of carbon dioxide delivered to the inlet 295*a* of motor 295. The signal is delivered through line 56*c* to controller 209 to initiate a defrost cycle when required to clear insulating frost from coils of evaporator 201.

The outlet passages of motors 294 and 295 are connected through a line 96 a secondary coil 250 of evaporator 201, said secondary coil being connected to line 98 through which carbon dioxide vapor is exhausted to atmosphere outside the cargo compartment 202 of the vehicle.

Each pneumatic motor 294 and 295 has a shaft 102 on which a fan blade 104 is mounted such that the flow of carbon dioxide vapor through pneumatic motors 294 and 295 cause fan blades 104 to rotate causing air within the cargo compartment 202 of vehicle 200 to pass across the primary coils 246 and 248 and the secondary coil 250 of evaporator 201.

When the programmable thermostat of temperature controller 209 calls for cooling, an indicator light (not shown) is illuminated and solenoid actuated liquid feed valve 42 is held open, delivering liquid carbon dioxide to primary coils 246 and 248 until the temperature in the cargo compartment sensed by sensor 56*a* causes controller 209 to close liquid feed valve 42 and to close solenoid actuated valves 222 and 224 to hold pressure in coils 246 and 248.

When controller 209 calls for defrosting, an indicator light (not shown) is illuminated, valve 68*a* is opened, to route liquid carbon dioxide through vaporizer 210 to the heating device 207, and the burner 72 is turned on.

During heat and defrost modes feed valve 42 is closed by a signal delivered through line 50 from controller 209.

Figure 6:
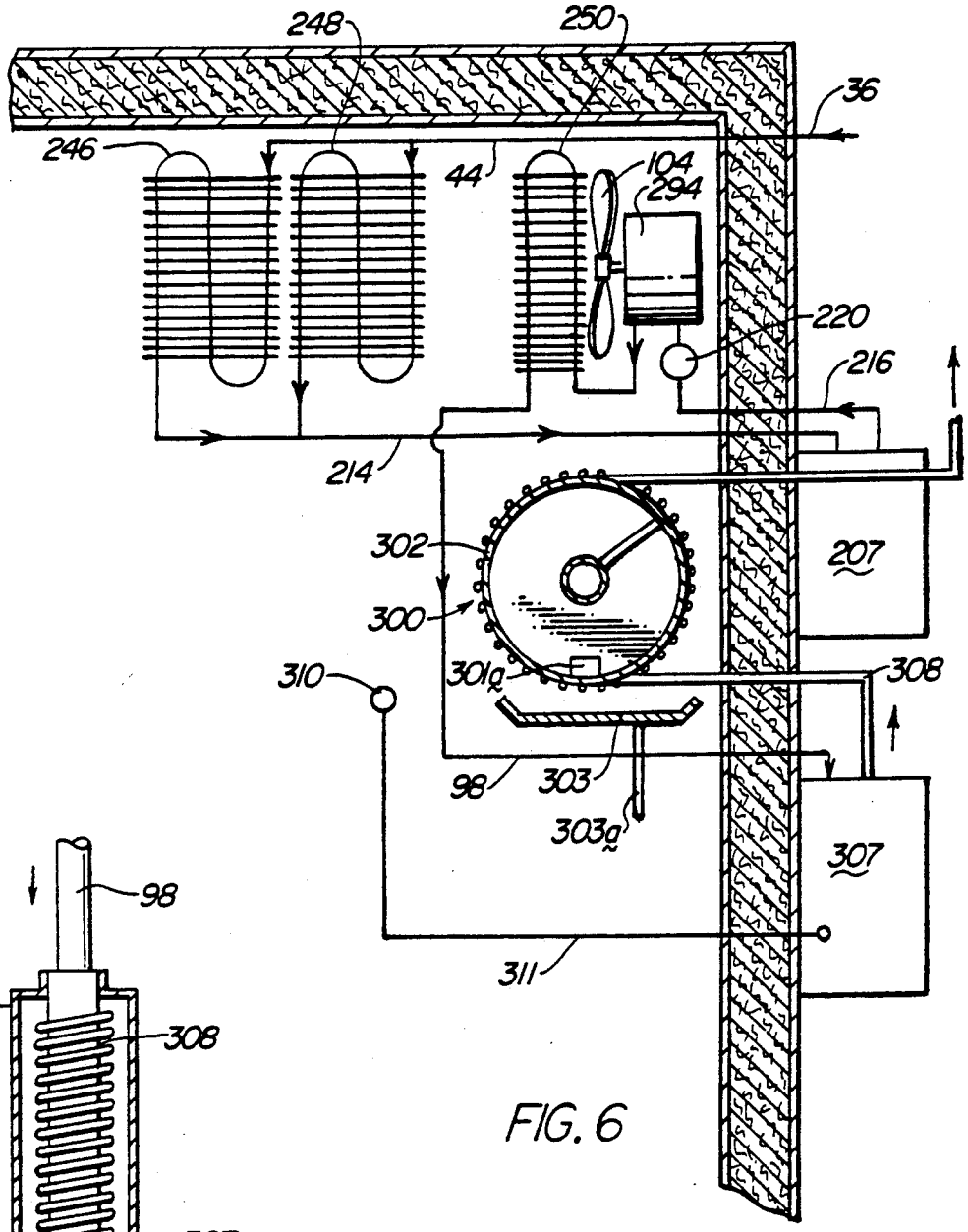
FIG. 6 is a diagrammatic view of a centrifugal separator to dehumidify air.

In the embodiment of the invention illustrated in FIG. 6 of the drawing, a dehumidifier 300 or centrifugal separator is provided adjacent the suction side of the fan 104 for extracting moisture from the air stream 400 adjacent the intake to the fan. Carbon dioxide vapor exhausted from the secondary coil 250 through conduit 98 is delivered in heat exchange relation with the wall of a hollow shroud 302 configured to cause air flowing through the shroud to move in heat exchange relation with the wall of the shroud which is chilled by carbon dioxide vapor exhausted from the secondary coil.

Since substantial heat has been absorbed by the carbon dioxide in the primary coils 246 and 248 and secondary coil 250, its temperature has been increased significantly. However, the temperature of the carbon dioxide vapor is still significantly less than the dewpoint of air in the cargo compartment 202 immediately after doors of the cargo compartment have been opened for loading and unloading cargo.

The shroud 302 preferably has sufficient mass to form a heat sink such that its surfaces will be cooled by carbon dioxide vapor exhausted from the secondary coil 250 and by air flowing through the shroud while the refrigeration system is in operation.

If the temperature of the surface of the shroud is less than the dewpoint of air moving in contact therewith, moisture will condense on the surface of the shroud and will flow by force of gravity into a drip pan 303 unless the surface of the shroud is less than the frost point of the air. It should be appreciated that the latent heat of condensation tends to warm the surface of the shroud on which moisture condenses. Consequently, the inner surface of the shroud scrubbed by air flowing thereacross is warmed faster than the heat is conducted through the shroud and carried away by the carbon dioxide vapor which is being exhausted from the system through conduit 303*a*.

It should be readily apparent that the dehumidifier 300 or centrifugal separator functions to precool the intake air 400 flowing to the fan 104 and removes humidity from the intake air to reduce the tendency of the primary coils 246 and 248 and secondary cooling coil 250 to ice up and require defrosting. It should be readily apparent that the carbon dioxide vapor flowing through the cooling coils and the shroud 302 of dehumidifier 300 flow in a direction counter to that of the air stream 400 flowing through evaporator 201.

Liquid carbon dioxide is heated in the primary cooling coils 246 and 248 where it is vaporized and the latent heat of evaporation is transferred through the walls of the primary cooling coils 246 and 248 from the air stream 402 flowing in heat exchange relation with the primary coils. Pressurized carbon dioxide vapor drives pneumatic fan motors 294 and 296 and provides additional cooling capacity as the carbon dioxide vapor depressurizes and flows into the secondary cooling coil 250.

After heat has been absorbed from the air stream 402 flowing across the secondary cooling coil 250, the carbon dioxide vapor is routed through the dehumidifier section 300 which has chilled surfaces warmer than those of the secondary cooling coil 250 across which the air stream 400 subsequently flows.

It should be readily apparent that heat absorbed by the carbon dioxide vapor flowing through the secondary cooling coil 250 preferably increases the temperature of the CO2 vapor to a temperature which is sufficiently low to cause air flowing across surfaces of the shroud 302 of dehumidifier 300 to condense but sufficiently high to prevent freezing of the condensate which is removed as liquid water through a condensate line 303*a*. However, if surfaces in dehumidifer 300 are too cold, heater 307 will be energized to heat CO2 vapor delivered to dehumidifier 300 to prevent icing or to melt ice if it forms.

From the foregoing it should be readily apparent that the counter flow carbon dioxide refrigeration system disclosed herein offers significant improvements over prior art devices since it employs a non-polluting refrigerant which is expanded through a pneumatic motor 294 for circulating air through the refrigeration compartment 202. The enthrapy control system allows the use of liquid carbon dioxide, a superior coolant, while overcoming problems which are unique to carbon dioxide refrigeration systems. Further, the dehumidification section 300 extracts moisture from the circulating air stream 400 to minimize icing of the cooling coils 246, 248 and 250 while using carbon dioxide vapor enroute to being exhausted to atmosphere.

OPERATION

The operation and function of the apparatus hereinbefore described is as follows:

A main power switch is moved to the "cool and heat" position for energizing control circuits in controller 209.

If the thermostat of temperature controller 209 is calling for a cooling mode, electrical current is directed to a lamp to provide visual indication that cooling is required and liquid carbon dioxide flows through line 32, valve 34, line 36, branch line 38, liquid feed valve 42 and inlet manifold 44 into the primary coils 246 and 248 of evaporator 201. The liquid carbon dioxide is at a temperature of approximately −60° F. and as heat is absorbed through the walls of primary coils 246 and 248 air adjacent thereto is cooled. Carbon dioxide from primary coils 246 and 248 passes through an exhaust manifold 213 and conduit 214 for driving pneumatic motors 294 and 295 causing fans 104 to circulate air across the primary and secondary coils. Carbon dioxide exhausted from motors 294 and 295 passes through line 96 to secondary coils 250 to absorb as much heat as possible before being exhausted through line 98 to ambient atmosphere. It should be readily apparent that no carbon dioxide passes into the cargo compartment of the vehicle.

As ice forms on coils 246 and 248 of the evaporator 201, the rate of heat transfer through walls of the coils is reduced. A sensor 56 is located in the stream so that the carbon dioxide coming into the air motor 295 flows across this temperature sensor. If carbon dioxide flowing to the inlet of motor 295 is too cold, for example less than −60° degrees F. a defrost mode is initiated.

When the circuit calls for a defrost mode the coil 43 of solenoid actuated valve liquid feed valve 42 closes valve 42 stopping the flow of liquid carbon dioxide to primary cooling coils 246 and 248 of evaporator 201.

The carbon dioxide is routed through the vaporizer 210 to the heater 207 and then delivers the hot carbon dioxide vapor through the primary coils 246 and 248 for defrosting.

When surface mounted sensor 60 on primary coil 248 indicates that the temperature of the surface of coil 248 has increased to, for example −40° F., it terminates the defrost mode.

It should be appreciated that the intense heat of vapor delivered from the heating device 207 results in very rapid melting of ice on surfaces of the coils 246 and 248 of evaporator 201 and on the surfaces of motors 294 and 295. Although motors 294 and 295 are running during the defrost mode, the defrost mode is so short that the cargo compartment is not heated appreciably.

The system is completely automatic employing thermostat control means to initiate cooling and heating cycles and employing means for sensing a temperature measurement for terminating both.

It should be appreciated that other and further embodiments of the invention may be devised without departing from the basic concept of the invention.

SECOND EMBODIMENT

As hereinbefore described, a dehumidifier 300 subjects the air stream 400, partially saturated with water, to cooling below its dew point so that water vapor is condensed and separated from the air stream. To prevent freezing the condensate, a thermostatically controlled heater 307 is provided in the line which delivers CO2 to the dehumidifier 300 to maintain the temperature of chilled surfaces in the dehumidifier slightly above the freezing point of water.

When the temperature of air drawn into the dehumidifier is less than a predetermined temperature the heater 307 in the dehumidifier feed line 308 may be deactivated to prevent heating the air stream.

As illustrated in FIG. 6 of the drawing a temperature sensor 310 is connected through a line 311 to heater 307. Sensor 310 delivers a signal related to the temperature of the air stream 400 flowing through the dehumidifier 300. When the temperature of air stream 400 reaches a minimum temperature of, for example, in a range between 28° F. and 32° F., heater 307 will be de-energized to prevent heating of vapor flowing through heater 307.

It should be readily apparent that heater 307 is controlled to maintain surfaces in dehumidifier 300 less than the temperature of the air stream 400 flowing therethrough. It should further be apparent that since the air stream 400 first contacts cold surfaces in dehumidifier 300, dehumidifier 300 precools the intake air to fan 104. If the thermostatic controls of heater 307 are adjusted to permit the formation of frost on surfaces in dehumidifier 300, heater 307 may be energized for defrosting dehumidifier 300 separately and independently from a defrost cycle of the primary evaporator coils 246 and 248 and the secondary coil 250. The provision of separate heaters 207 and 307 provides a system which can be operated under a wide range of operating conditions. For example, in certain southern geographical regions near bodies of water, summer temperatures may range above 100° F. and the relative humidity of the air may approach 100%.

When the doors of the cargo compartment are opened cold air inside immediately flows out while hot humid air fills the compartment. The dehumidifier 300 is intended to remove as much moisture from the air as possible to minimize the requirement for defrosting the primary and secondary coils 246, 248 and 250 of the evaporator 201.

Latent heat of condensation is transferred from the air stream 400 to chilled surfaces in the dehumidifier 300 during the change in state of the moisture in the air stream 400 from vapor to liquid. By controlling the minimum temperature of the chilled surfaces, the transfer of heat from the air stream 400 to the chilled surfaces is controlled to permit gravity flow of condensate into a condensate tray 303 below the chilled surfaces and removal of condensate through a condensate line 303*a* to the outside of the cargo compartment.

From the foregoing it should be readily apparent that liquid carbon dioxide is delivered to a primary evaporator 245 such that sufficient heat is absorbed to evaporate the liquid carbon dioxide to form pressurized vapor. The vapor is heated to a temperature to prevent solidification of the carbon dioxide when it becomes depressurized, by delivering the pressurized vapor through heater 207 while one or both of the burners 312 and 310 is ignited. The pressurized vapor, which has been heated in the fuel burning heater 207, is depressurized as it flows through motors 294 and 295 to provide isentropic expansion of the vapor into the second heat exchanger 250.

Vapor from the secondary heat exchanger 250 in evaporator 201 is delivered through a second heater 307 to maintain surfaces in dehumidifier 300 at a temperature below the dewpoint of air in the compartment 202; and circulating air in the compartment 202 moves in heat exchange relation with the surfaces in the dehumidifier 300. Subsequently, the dehumidifed air stream flows in heat exchange relation with the carbon dioxide in the first and second heat exchangers 246 and 248. Moisture in the circulating air condenses on surfaces in the dehumidifier 300 enroute to the heat exchangers 246, 248, and 250.

The step of heating the vapor to a temperature to prevent solidification of carbon dioxide when it depressurizes is preferably accomplished by burning fuel in heat exchange relation with the pressurized vapor in heat exchanger 207. However, an electric in-line heater 307, as illustrated in FIG. 5 of the drawing, may be employed in lieu of fuel burning heater 207, if it is deemed expedient to do so.

The air stream 400 is preferably delivered along a serpentine path such that centrifugal force urges moisture in an air stream 400 into heat exchange relation with chilled surfaces in the dehumidifier 300. The serpentine path is preferably formed by a spiral or screw shaped baffle 301 extending through the coil of cylindrical shaped shroud 302 of dehumidifier 300. Drain passages 301*a* are formed in lower portions of baffle 301 to permit flow of condensate to the drain pan 303.

As described hereinbefore, heaters 207 and 307 are employed for controlling the entropy or internal heat of the carbon dioxide delivered through the system which controls the temperature in the cargo compartment of a trailer. The source 211 of liquefied carbon dioxide is preferably a stainless steel, double-walled, vacuum-insulated cryogen tank located under the body of the trailer for delivering liquid carbon dioxide to the evaporator 201. The evaporator 201 may be mounted inside the cargo compartment 202 of the trailer or optionally mounted outside of the cargo compartment and arranged to draw air from the cargo compartment through the evaporator 201 and then returning the air to the cargo compartment. Heat absorbed by the liquid carbon dioxide in the primary coils 246 and 248 of the evaporator 201 vaporizes the carbon dioxide. Check valves 294*a* and 295*a* maintain the carbon dioxide vapor pressurized. However, to assure that the pressurized carbon dioxide vapor does not solidify when it is depressurized as it flows through pneumatically driven motors 294 and 295, the pressurized carbon dioxide vapor is delivered through conduit 214 and fuel burning heater 207 for controlling the temperature and pressure of the carbon dioxide delivered into pneumatically driven motors 29 and 295.

From the foregoing it should be readily apparent that since the carbon dioxide is not released into the trailer, a normal oxygen atmosphere is maintained at all times in the cargo compartment 202 in the trailer 200. In conventional freon-mechanical refrigeration systems, fans operate at all times, causing product dehydration. In contrast, the cryogenic system hereinbefore described reduces air movement and consequently reduces product dehydration because the fans 104 only operate during the refrigeration mode and minimally during the heating mode.

The effective temperature range of the liquid carbon dioxide system hereinbefore described is about −20° F. to about +80° F. Certain transport refrigeration cargoes such as chilled beverages, fresh fruit, fresh vegetables, candy, computers and pharmaceutical products require maintenance of cargo temperatures above freezing while refrigeration of sub-zero and frozen products requires lower temperature ranges.

It should be readily apparent that heaters 207 and 307 are mounted in the system for controlling the enthropy of the carbon dioxide, to effectively remove moisture from air flowing into the dehydration section 300 of the system, and to prevent solidification of carbon dioxide vapor when it is suddenly depressurized as it flows through the system.

Having described the invention, I claim:

1. A method of refrigerating air in a compartment comprising the steps of: delivering liquid carbon dioxide through a first heat exchanger such that sufficient heat is absorbed to evaporate the liquid carbon dioxide to form pressurized vapor; heating the vapor to a temperature to prevent solidification of the carbon dioxide when it becomes depressurized; depressurizing the vapor to provide isentropic expansion of the vapor into a second heat exchanger; delivering vapor from the second heat exchanger to maintain surfaces in a dehumidifier at a temperature below the dewpoint of air in the compartment; and circulating air in the compartment in heat exchange relation with the surfaces in the dehumidifier and subsequently in heat exchange relation with carbon dioxide in the first and second heat exchangers such that moisture in the circulating air condenses on surfaces in the dehumidifier enroute to the first and second heat exchangers.

2. A method of refrigerating air in a compartment according to claim 1, the step of heating the vapor to a temperature to prevent solidification of the carbon dioxide when it becomes depressurized comprising the step of: delivering the pressurized vapor through a fuel burning heater; and burning fuel in heat exchange relation with the pressurized vapor.

3. A method of refrigerating air in a compartment according to claim 2, with the addition of the step of: sensing the temperature of carbon dioxide vapor before it is depressurized to provide isentropic expansion into the second heat exchanger; and controlling a supply of fuel to the heater in response to changes in the sensed temperature.

4. A method of refrigerating air in a compartment according to claim 1, the step of circulating air in the compartment in heat exchange relation with the surfaces in the dehumidifier, comprising the step of circulating the air along a serpentine path such that centrifugal force urges moisture in an air stream into heat exchange relation with chilled surfaces in the dehumidifier.

5. The method of refrigerating air in a compartment according to claim 1, the step of heating vapor to a temperature to prevent solidification of carbon dioxide when it becomes depressurized comprising the steps of: sensing temperature of the pressurized carbon dioxide vapor; and controlling heat transferred to the pressurized carbon dioxide vapor to control condensation of moisture on surfaces in the dehumidifier.

6. A method of controlling the heat transfer rate through a wall of a tube in a compartment comprising the steps of: delivering liquid carbon dioxide into the tube; moving fluid in the compartment in heat exchange relation with the tube such that heat is absorbed by the carbon dioxide to form pressurized carbon dioxide vapor in the tube; heating the pressurized carbon dioxide vapor; delivering the heated carbon dioxide vapor to drive a motor driven fan to move fluid in the compartment in heat exchange relation with the tube; and controlling the flow of heated vapor to the motor to prevent solidification of the carbon dioxide as it depressurizes upon reaching the pneumatic motor chambers.

7. The method of claim 6, with the addition of the steps of: sensing temperature of carbon dioxide exhausted from the tube; and heating surfaces of the tube when the temperature of carbon dioxide flowing to the motor driven fan is less than a predetermined temperature.

8. The method of claim 7 wherein the step of sensing temperature of carbon dioxide is accomplished by positioning a temperature sensor in heat exchange relation with carbon dioxide flowing to the motor.

9. The method of claim 7 wherein the step of heating surfaces of the tube comprises: heating a volume of carbon dioxide; and delivering the heated carbon dioxide through the tube.

10. The method of claim 9 with the addition of the steps of: sensing the temperature of the surface of the tube; and terminating heating of the surfaces of the tube when the tube surface increases to a predetermined temperature.

11. A method of controlling temperature in a compartment comprising the steps of: circulating liquid carbon dioxide through a primary coil such that heat is absorbed by the carbon dioxide; changing the enthalpy of carbon dioxide exhausted from the primary coil to assure that it is in a vapor phase; delivering the carbon dioxide vapor through a pneumatic motor arranged to drive a fan; and circulating carbon dioxide from the pneumatic motor through a secondary coil, the primary and secondary coils being positioned such that the fan driven by the pneumatic motor moves air in heat exchange relation with the coils.

12. The method of claim 11 with the addition of the step of: stopping flow of liquid carbon dioxide to the primary coil when a predetermined quantity of ice has formed on surfaces of the primary coil; and directing heated carbon dioxide vapor through the primary coils, through the motor, and through the secondary coil for melting ice on surfaces thereof.

13. Temperature control apparatus comprising, a coil; means to deliver fluid through said coil; means to move air across the coil; first sensor means to sense temperature of carbon dioxide exhausted from the coil; second sensor means to sense the temperature of the surface of the coil; means to generate a signal when the temperature of carbon dioxide exhausted from the coil is less than a predetermined temperature; means energized by said signal to heat surfaces of the coil to melt ice thereon; and means energized by said second sensor to terminate heating of the surfaces of the coil.

14. The combination called for in claim 13 wherein the means to move air across the coil comprises: a fluid driven motor connected in driving relation with impeller means; and means to direct fluid from said coil through the fluid driven motor.

15. Temperature control apparatus according to claim 14 with the addition of: orifice means adjacent the inlet to said fluid driven motor.

16. Temperature control apparatus according to claim 15 with the addition of: flow control valve means in said means to direct fluid through said fluid driven motor.

17. The Combination called for in claim 13, wherein the means energized by said signal to heat surfaces of the coil comprises: heater means; signal responsive valve means arranged to deliver carbon dioxide to the heater means; and means to deliver heated carbon dioxide from the heater means to the coil.

18. The combination called for in claim 13 wherein the means to deliver fluid through the coil comprises: a container; conduit means connected between said container and the coil; and means in said conduit means for controlling the flow of carbon dioxide therethrough.

19. Apparatus to control temperature in a cargo compartment of a trailer comprising: a source of liquefied carbon dioxide carried by the trailer; evaporator means positioned in heat exchange relation with air in the compartment; first conduit means connecting said evaporator means and the source of liquid carbon dioxide; heat exchanger means; second conduit means connecting the heat exchanger means with said evaporator means; a pneumatically operated motor; fan means driven by said motor arranged to cause air in the compartment to circulate over surfaces of the evaporator means, said heat exchanger means being adapted to deliver carbon dioxide from said evaporator means to said motor in a temperature range to prevent solidification of carbon dioxide as it becomes depressurized in said motor.

20. The combination called for in claim 19 with the addition of: temperature sensor means adapted to sense the temperature of vapor delivered to said motor; and controller means adapted to defrost said evaporator when the temperature of vapor drops to near the freezing point of carbon dioxide.

21. The combination of claim 20, said fan means having an intake passage; and with the addition of heat exchanger means adapted to move temperature controlled carbon dioxide vapor in heat exchange relation with air flowing through said intake passage.

22. The combination of claim 21, said heat exchanger means comprising heater means; conduit means connecting said pneumatically operated motor to discharge carbon dioxide into said heater means; a hollow cylindrical shroud extending around said intake passage; a screw shaped baffle in said shroud; means in heat exchange relation with said shroud and said baffle configured to receive vapor from said heater means; and temperature sensor means associated with said heater means and air flowing through said intake passage for maintaining temperature of carbon dioxide in heat exchange relation with air flowing through the intake passage in a predetermined temperature range.

* * * * *